United States Patent [19]

Vitak et al.

[11] Patent Number: 4,876,848

[45] Date of Patent: Oct. 31, 1989

[54] FIBER OPENING DEVICE HAVING FIBER CLEARING SUCTION TUBE

[75] Inventors: Josef Vitak, Liberec; Frantisek Burysek, Usti nad Orlici, both of Czechoslovakia

[73] Assignee: Vyzkumny ustav bavinarsky, Usti nad Orlici, Czechoslovakia

[21] Appl. No.: 239,477

[22] Filed: Sep. 1, 1988

[30] Foreign Application Priority Data

Sep. 2, 1987 [CS] Czechoslovakia ..... 6375-87

[51] Int. Cl.[4] ..... D01H 7/885; D01H 7/888

[52] U.S. Cl. ..... 57/301; 57/304; 57/408

[58] Field of Search ..... 57/406, 407, 408, 300–302, 57/304, 411, 305, 261–263

[56] References Cited

U.S. PATENT DOCUMENTS 4,038,812 8/1977 Stahlecker ..... 57/471 X
4,041,687 8/1977 Motobayashi et al. ..... 57/301
4,089,155 5/1978 Stahlecker ..... 57/263

FOREIGN PATENT DOCUMENTS 240166 6/1987 Czechoslovakia .
2555058 6/1977 Fed. Rep. of Germany .

*Primary Examiner*—John Petrakes
*Attorney, Agent, or Firm*—Klein & Vibber

[57] ABSTRACT

A fiber opening device of the spinning unit of an open-end rotor spinning machine, for avoiding misalignments in the connection between the front end of the sucking tube of a travelling automatic service unit and the inlet port of the spinning unit, in order to prevent false air from being sucked in at this contact point. According to the invention, a sucking tube is provided with a self-adjustable sealing head having a front sealing surface to be fitted onto the front wall of the spinning unit. In the inner space of the sealing head a partially spherical concave surface fitted onto a mating, partially spherical convex surface provided at the end of the said sucking tube.

3 Claims, 2 Drawing Sheets

FIBER OPENING DEVICE HAVING FIBER CLEARING SUCTION TUBE

BACKGROUND OF THE INVENTION

The invention relates to an improved fiber opening device for a spinning unit of open-end rotor spinning machines, comprising a fiber opening cylinder in the cavity of an opening housing, said cavity communicating via a cleaning hole with an ejecting duct merging into an impurity withdrawing duct which has, on the one hand, an outlet opening connected to a central impurity withdrawing conduit provided in the machine frame along the spinning units, and, on the other hand, an atmosphere air inlet provided in the front wall of the fibre opening housing; said inlet is adapted to be coupled to a sucking tube of a travelling automatic service unit.

In the German Published Pat. Application (DE-OS) No. 2,555,058 a spinning unit has been described, wherein the front wall of the fiber opening housing is provided with a hole which is in communication with a cleaning space. This hole is adapted to be connected with the sucking tube of the service unit. During cleaning and spinning-in processes, the sucking tube tightly bears on the wall defining the hole of the opening housing. The sucking tube is mounted for reciprocation on said service unit.

However, it has been ascertained by means of practical tests of the aforementioned device that it is not possible to effect the perfect connection between the mouth of the sucking tube and the hole in the front wall of the spinning unit, through which the cleaning duct is in communication with surface of said unit, and that between these elements a gap forms, through which, during the fibre transport, undesirable air is sucked in whereby vacuum losses occur.

With the above-described impurity and fibre withdrawal in view, an eventual leakage is not as serious as with the device disclosed in the Czechoslovak Authorship Certificate No. 240,166, wherein onto the front wall of the spinning unit there is led out only the atmospheric air inlet of the impurity withdrawing duct which merges by its outlet opening into the central conduit on the machine frame, and into which an ejecting conduit opens. The ejecting conduit is connected to the cleaning hole in the cavity of the fiber opening housing. Air continuously flows through the aforedescribed air inlet during the machine operation. During the course of the spinning-in process, the air inlet can be coupled onto the sucking tube whose function is to withdraw initially, spun-in unsuitable fibres at the beginning of the sliver feeding process. Since, however, the withdrawing duct is coupled to the central impurity conduit, and the initial fibres are withdrawn by the sucking tube of the automatic service unit, the vacuum in the sucking tube has to overcome that prevailing in the central impurity withdrawing conduit. In this case, however, any leakage between the sucking tube and the front wall of the fiber opening housing constitutes a considerable shortcoming since it produces problems in the fiber withdrawal. In such a case fibers are taken off imperfectly and accumulate at the transition region between the ejection duct and the withdrawing duct. In extreme cases they may even completely choke these ducts. Simultaneously, the quality of splices and of final yarn is negatively influenced. Another drawback resides in that the sucking effect in the central conduit may cause, in case of a tight connection, the spinning unit to be opened.

SUMMARY OF THE INVENTION

It is an object of the invention to eliminate the aforedescribed disadvantages of the prior art open-end spinning machines and to provide an improved fiber opening device, wherein false air is prevented, in case of any misalignment in the connection of the front wall of the spinning unit with the front face of the sucking tube, from being sucked in at this contact point.

Another object of the invention is to facilitate the release of the sucking tube from the spinning unit after the spinning-in process, in a relatively simple and reliable way.

To meet the above specified objects, the sucking tube is provided, according to the invention, with a self-adjustable sealing head which has a front sealing surface to be fitted onto the front wall of the spinning unit, and has in its inner space a partially spherical concave surface provided at the end of said sucking tube.

In order for the sucking tube to be easily detached from the spinning unit, it is preferable if the self-adjustable sealing head of the sucking tube is provided with at least one hole or vent for admitting air into the inner space of said self-adjustable sealing head.

By providing such a self-adjustable sealing head,the effect of the aforedescribed improvement of the sucking tube consists effecting perfectly tight sealing of the transition region between the inlet port of the impurity withdrawing duct of the spinning unit and the sucking tube of the travelling automatic service unit. In this way it is made possible to ensure a sufficient vacuum level in both the sucking tube and the withdrawing duct, whereby the fiber take-off at the beginning of the spinning-in process is improved.

Another beneficial effect of the device according to the present invention resides in a reduction of force necessary for detaching the sucking tube from the inlet port of the impurity withdrawing duct in the front wall of a spinning unit during the permanent vacuum prevailing in the central conduit, and particularly by providing an instantaneous local vacuum reduction by sucking additional air through auxiliary holes in the self-adjustable sealing head if the latter should be detached.

BRIEF DESCRIPTION OF THE DRAWINGS

In order that the present invention be better understood and carried into practice, some preferred embodiments thereof will hereinafter be described with references to the accompanying schematic drawings in which.

DETAILED DESCRIPTION

Figure 1:
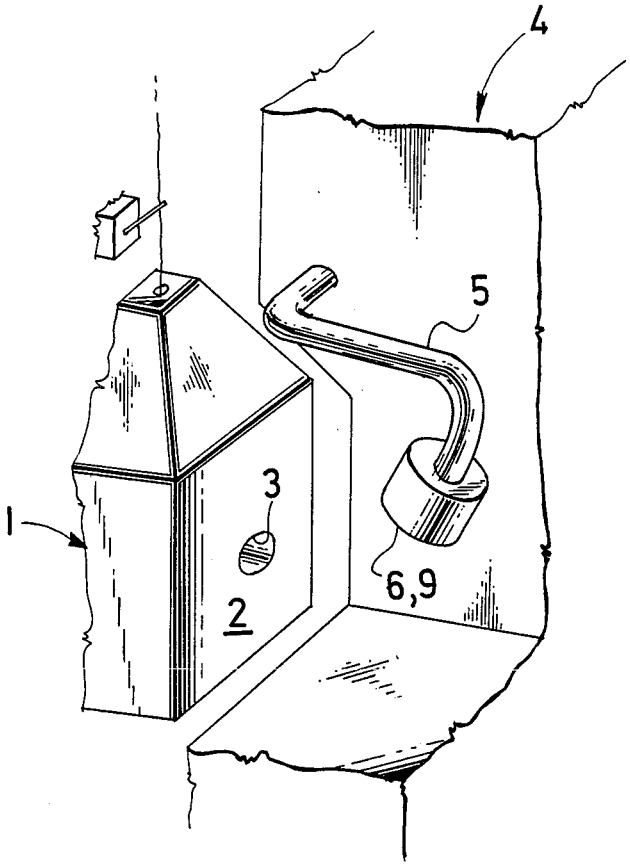
FIG. 1 is a perspective view showing the front wall of the spinning unit of an open-end rotor spinning machine and a part of a travelling automatic service unit with its sucking tube provided with a self-adjustable sealing head, before being fitted onto the inlet port in said front wall.

FIG. 1 shows one spinning unit 1 from a row of spinning units disposed side-by-side along the open-end rotor spinning machine. The fiber opening device of the spinning unit comprises a well-known opening cylinder received in the cavity of the opening housing. The latter communicates with a well-known ejecting duct having a cleaning opening, and the ejecting duct merges into an impurity withdrawing duct. The latter communicates via its outlet port, with a central impurity withdrawing conduit provided in the machine frame along the row of spinning units. In the front wall 2 of the spinning unit 1 or the fiber opening housing thereof, there is provided an inlet port 3 for admitting atmospheric air.

The open-end rotor spinning machine is associated with a automatic travelling service unit 4 having a sucking tube 5 which is provided with a self-adjustable sealing head 6 and is swingably mounted in said unit 4. The sucking tube 5 is connected to a vacuum source (not shown) arranged in the service unit 4.

The following description of an embodiment of prior art (Czechoslovak Authorship Certificate No. 240,166) is brief, and the sectional view of the spinning unit is omitted because it forms part of the state of the art. The following description relates directly to the subject matter of the invention.

Figure 2:
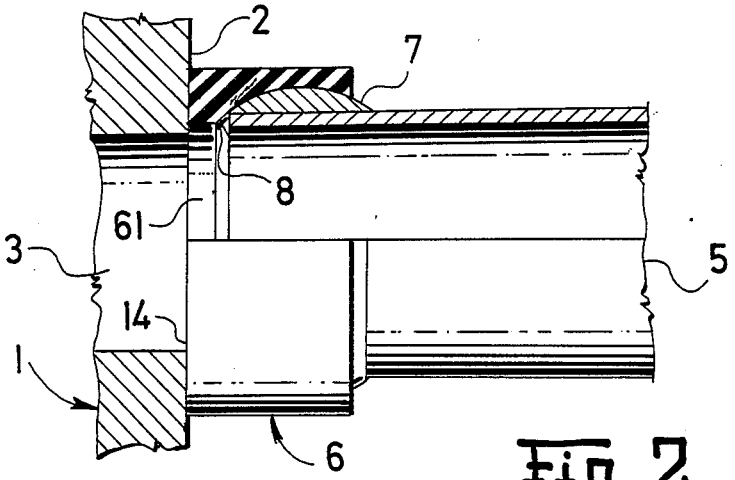
FIG. 2 is a sectional view of the end portion of the sucking tube coupled to the inlet port of the withdrawing duct by means of the self-adjustable sealing head, with mated spherical surfaces.

FIG. 2 shows the sucking tube 5 which is fitted, during the fiber sucking period of the spinning-in process, onto the inlet port 3 in the front wall 2 of the spinning unit 1. The self-adjustable sealing head 6 of the sucking tube 5 is shown as bearing on the front wall 2 of the spinning unit 1 whereby said port 3 is covered by the mouth of said head 6.

As can be seen in the sectional view (FIG. 2), the sucking tube 5 is provided at its free end with the self-adjustable sealing head 6. The end of said tube 5 has a partially convex spherical surface 7 while said self-adjustable sealing head 6 is provided in its inner space 61 with a mating, partially spherical concave surface 8. For the reasons of assembly, the self-adjustable sealing head 6 has to be made either of several parts, or can form an integral element of an elastic or resilient material such as rubber, polyurethane, or the like. In this way a sealingly tight fit is made possible, whereby the concave spherical surface 8 in the inner space 61 of the self-adjustable sealing surface 6 sealingly fits onto the convex spherical surface 7 at the end of the sucking tube 5.

Figure 3:
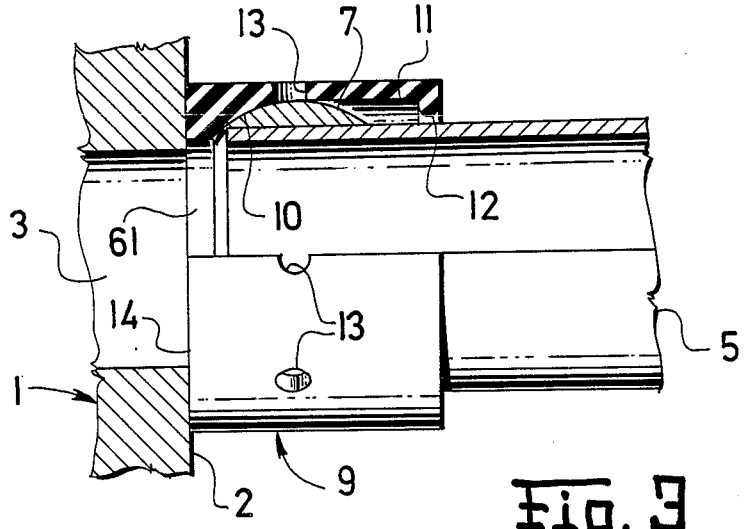
FIG. 3 is a similar view of an alternative embodiment of the connection of the two elements.

FIG. 3 shows an alternate embodiment of the self-adjustable sealing head 9 provided at the end of the sucking tube 5. While the end of said tube 5 has also the convex spherical surface 7, the concave spherical surface 10 in the inner space 61 of said socket 9 merges into an inner cylindrical surface 11 which terminates at a flanged edge 12 whose inner diameter is smaller than the maximum diameter of the convex spherical surface 7 at the end of the sucking tube 5. The self-adjustable sealing head 9 is further provided with one or more holes 13 for admitting air to be sucked in during the period of detaching the sucking tube 5 from the front wall 2 of the spinning unit 1.

Figure 4:
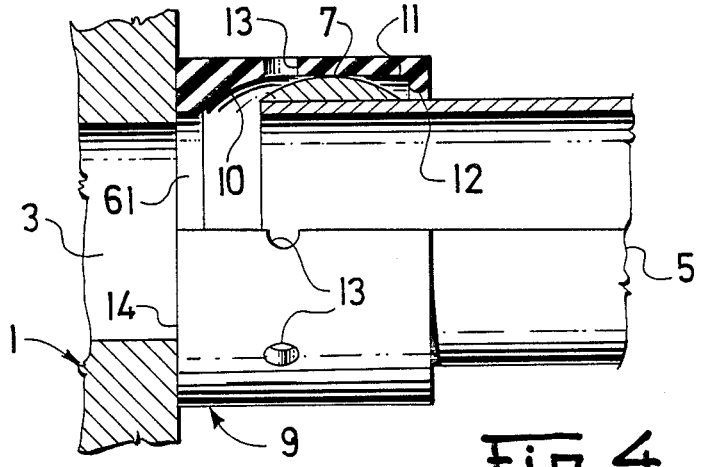
FIG. 4 is a view corresponding to FIG. 3, except that the sucking tube is shown as being detached by admitting auxiliary air.

The detaching period is clearly illustrated in FIG. 4 and will be described in more detail in the description of the operation of the device. The opening 13 is provided at least on the transition region of the socket 9 between the concave spherical surface 10 and cylindrical surface 11 of the socket 9, or in the region of said concave surface 10 only. The self-adjustable sealing socket 6 or 9, respectively, has further a front sealing face 14.

MANNER OF OPERATION

The operation of the fiber opening device according to the invention is based on the fact that at the beginning of the spinning-in process, fibers have to be sucked off through the cleaning opening, the ejecting duct and the impurity withdrawing duct, i.e., through its inlet port 3 in the front wall 2 of the spinning unit 1. This operation is serviced by the travelling automatic service unit 4, and particularly by its sucking tube 5 which, due to the fact that it is connected to a vacuum source, when approaching the front wall 2 of the spinning unit 1, adheres with its front sealing surface 14 of its self-adjustable sealing head 6 or 9, respectively, to said front wall 2 and covers its inlet port 3, whereupon fibers are sucked off from the fibrous beard. Since it is necessary to perfectly seal the contact between the sucking tube 5 and the front wall 2 of the spinning unit 1, and the perfect alignment of all of the spinning units 1 in the open-end rotor spinning machine cannot be attained, the sealing head 6 or 9, respectively, is made as a self-adjustable element relative to the plane of the front wall 2, this effect is achieved by mounting said head 6 or 9, respectively, at the end of the sucking tube 5 by means of the spherical surfaces 7, 8, and 10, respectively. Due to the fact that the sucking tube 5 is pushed toward the front wall 2 by force, the sealing of the connection between both the front wall 2 of the spinning unit 1 and the front sealing surface 14 of the self-adjustable sealing head 6 or 9, respectively, and the concave spherical surface 8 or 10, respectively, of the latter and the convex spherical surface 7 at the end of the sucking tube 5 is required. The detachment of the sucking tube 5 from the front wall 2, after the fibers have been sucked off, is effected, after overcoming a resistance caused by subatmospheric pressure in the sucking tube 5, by disengaging the two spherical surfaces 7, 8 or 10, respectively, from each other in opposite directions. The operation of the device shown in FIGS. 3 and 4 is analogous to that hereinabove set forth; after the sucking tube 5 is caused to approach the front wall 2 of the spinning unit 1, it adheres by its front sealing surface 14 of the self-adjustable sealing head 9 to said front wall 2. This effect is obtained by the engagement of the convex spherical surface 7 at the end of the sucking tube 5 with the concave spherical surface 10 in the inner space 61 of the self-adjustable sealing head 9, the contact of said spherical surfaces 7 and 10 also ensuring the tightness when the sucking tube 5 is forced to the front wall 2 of the spinning unit 1.

After fibers have been sucked off through the sucking tube 5 out of the inlet port 3 of the fibre withdrawing duct of the spinning unit 1, the tube 5 will be detached from the front wall 2 of the spinning unit 1, and particularly within two phases. The first phase of the detachment motion is shown in FIG. 4, wherein after disengaging the concave spherical surface 10 of the self-adjustable sealing head 9 and the concave spherical surface 7 at the end of the sucking tube 5 from each other, and after spacing them apart, the convex spherical surface 7 will engage the cylindrical surface 11 in the interior of the self-adjustable sealing head 9. Thus the air flowing between the spaced apart spherical surfaces 7 and 10 is admitted together with additional air whereby an instantaneous local vacuum reduction occurs in the space between the end of the sucking tube 5 and the front wall 2 of the spinning unit 1 so that the front sealing surface 14 of the self-adjustable sealing head 9 can be removed from said front wall 2 without expending any special force. In order to prevent the two elements 9 and 5 from being disconnected from each other, the cylindrical surface 1 of the self-adjustable sealing head 9 is provided with the flanged edge 12, the inner diameter of which has to be smaller than the diameter of the convex spherical surface 7 at the end of the sucking tube 5. In this way there is obtained a reduction of the force necessary for detaching the sucking tube 5 from the front wall 2 of the spinning unit 1 as well as the reduction of wear of the contact sealing surfaces; apart from this, the spinning unit is prevented from being unintentionally opened.

In the second phase of detachment, the sucking tube 5 together with the self-adjustable sealing head 9 is removed whereby the sucking of fibers from the fibrous beard is discontinued.

While we have disclosed several embodiments of the present invention, it is to be understood, that these embodiments are given by example only and not in a limiting sense.

What we claim is:

1. A fiber opening device for a spinning unit of open-end-rotor spinning machines, having a row of spinning units arranged next to each other, such spinning unit including a fiber opening housing having a cleaning hole, said housing communicating via said cleaning hole with an ejecting duct merging into an impurity withdrawing duct which has, on the one hand, an outlet opening connected to a central impurity withdrawing conduit provided in the machine frame along the spinning units, and, on the other hand, an atmospheric air inlet provided in the front wall of the fiber opening housing, and comprising in combination an automatic travelling service unit having a sucking tube, said air inlet being selectively coupled to said sucking tube of the travelling automatic service unit; said sucking tube being pivotally mounted on said service unit, said tube being provided with a free end having a self-adjustable sealing head slidably movably mounted over a predetermined distance on said tube and having a front sealing surface adapted to sealingly engage said front wall of the fiber opening housing, said head having in its interior a partially spherical concave surface which surrounds the free end of said tube and which fits onto a mating, partially spherical convex surface disposed at the end of said sucking tube.

2. The fiber opening device as set forth in claim 1, wherein said head has a flanged edge, said concave spherical surface merging, in the interior of the self-adjustable sealing head, into a cylindrical surface terminating at said flanged edge, and wherein in the transition region of said concave spherical surface into said cylindrical surface at least one hole is provided in said head for admitting air into the inner space of said self-adjustable sealing head.

3. The fiber opening device according to claim 1, wherein the self-adjustable sealing head is made of a resilient material such as rubber or man-made polymeric material.

* * * * *